US007647906B2

(12) United States Patent
Takada et al.

(10) Patent No.: US 7,647,906 B2
(45) Date of Patent: Jan. 19, 2010

(54) VERTICAL INTERNAL COMBUSTION ENGINE PROVIDED WITH BELT-DRIVE TRANSMISSION MECHANISM

(75) Inventors: Hideaki Takada, Wako (JP); Yutaka Kubota, Wako (JP); Tatsuya Kuroda, Wako (JP); Kazutake Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 208 days.

(21) Appl. No.: 11/807,481

(22) Filed: May 29, 2007

(65) Prior Publication Data

US 2007/0277761 A1 Dec. 6, 2007

(30) Foreign Application Priority Data

Jun. 5, 2006 (JP) ..... 2006-156681

(51) Int. Cl.
*F01L 1/02* (2006.01)

(52) U.S. Cl. ..... 123/90.31; 123/196 W; 123/90.27; 123/195 C; 123/196 R

(58) Field of Classification Search ..... 123/196 W, 123/196 R, 90.1, 90.3, 572, 573, 574, 90.27, 123/90.33; 440/88 L, 85
See application file for complete search history.

(56) References Cited

U.S. PATENT DOCUMENTS 4,944,264 A * 7/1990 Murasaki et al. ..... 123/195 C
4,974,561 A * 12/1990 Murasaki et al. ..... 123/90.31
5,722,360 A * 3/1998 Tsunoda et al. ..... 123/195 P
5,921,827 A * 7/1999 Ichihashi ..... 440/77
6,062,928 A * 5/2000 Watanabe et al. ..... 440/88 R
6,264,515 B1 * 7/2001 Mineno et al. ..... 440/83
6,276,327 B1 * 8/2001 Fukuoka et al. ..... 123/196 W
6,302,749 B1 * 10/2001 Tawa et al. ..... 440/76
6,325,037 B1 * 12/2001 Takahashi et al. ..... 123/195 P
6,427,658 B1 * 8/2002 Toyama et al. ..... 123/195 P
6,532,930 B2 * 3/2003 Kobayashi et al. ..... 123/196 R
6,619,247 B2 * 9/2003 Kobayashi ..... 123/90.15
2002/0035983 A1 * 3/2002 Kobayashi ..... 123/196 M
2003/0017767 A1 * 1/2003 Gokan ..... 440/88
2005/0005894 A1 * 1/2005 Fukuda et al. ..... 123/196 W
2005/0118900 A1 * 6/2005 Takahashi et al. ..... 440/88 L

FOREIGN PATENT DOCUMENTS

JP 02-275020 11/1990

* cited by examiner

*Primary Examiner*—Michael Cuff
*Assistant Examiner*—Hung Q Nguyen
(74) *Attorney, Agent, or Firm*—Carrier, Blackman & Associates P.C.; Joseph P. Carrier; William D. Blackman

(57) ABSTRACT

A vertical internal combustion engine E is incorporated into an outboard motor or the like. The vertical internal combustion engine E includes a crankshaft 18 enclosed in a crank chamber 20, and a belt-drive transmission mechanism 50 including a rubber belt 53 for transmitting power of the crankshaft 18 to a camshaft 24, and held in a belt chamber 63. The belt chamber 63 is isolated from the crank chamber 20 by a lower case 61 of a transmission case 60 holding the belt-drive transmission mechanism 50 therein such that the flow of an oil-containing gas from the crank chamber 20 deviates from a direction toward the belt 53. The belt 53 is lubricated with oil injected concentratedly into the belt chamber 63 through jet nozzles 80 disposed in the belt chamber 63. Thus the excessive exposure of the belt 53 to the oil-containing gas from the crank chamber can be avoided, the life of the belt can be extended and the belt is lubricated properly.

19 Claims, 7 Drawing Sheets

VERTICAL INTERNAL COMBUSTION ENGINE PROVIDED WITH BELT-DRIVE TRANSMISSION MECHANISM

BACKGROUND OF THE INVENTION

1. Field of the Invention

The present invention relates to a vertical internal combustion engine having a crankshaft held in a crankcase with its center axis vertically extended, and provided with a belt-drive transmission mechanism including a lubricated rubber belt for transmitting the power of the crankshaft to a driven device. The vertical internal combustion engine is incorporated into, for example, an outboard motor.

2. Description of the Related Art

A vertical internal combustion engine disclosed in, for example, JP-A 2-275020 is provided with a belt-drive transmission mechanism including a rubber belt for transmitting the power of the crankshaft to a driven device. The belt-drive transmission mechanism is placed in a belt chamber, and the rubber belt is lubricated with oil that flows from the crankcase into the belt chamber.

If the belt chamber is opened into the crankcase and the components of the belt-drive transmission mechanism including a belt and pulleys are exposed to the atmosphere in the crankcase, the belt is likely to be exposed to gas containing oil mist and blowby gases. Hereinafter, this gas will be referred to as "oil-containing gas". Moreover, the belt is wetted with oil drops splashed by the rotating crankshaft and with the oil adhered to the pulleys and scattered when the pulleys rotate. Consequently, the belt is excessively lubricated. If the belt is exposed excessively to the oil and blowby gases contained in the oil-containing gas and to the high-temperature oil-containing gas, components of the oil and the blowby gases accelerate the degradation of the rubber belt and shorten the life of the rubber belt. If the width and thickness of the belt is increased and the strength of the belt is enhanced to reduce the detrimental effect of degradation on the belt, the cost and size of the belt-drive transmission mechanism increase. If the belt is not satisfactorily lubricated, the belt is abraded by increased friction between the belt and the pulley and the life of the belt shortens.

Thus it is difficult to suppress the degradation of the belt by detrimental effects of the oil and blowby gases contained in the oil-containing gas and to ensure the proper lubrication of the belt when the belt is lubricated with the oil contained in the oil-containing gas from the crankcase.

SUMMARY OF THE INVENTION

The present invention has been made under such circumstances and it is therefore an object of the present invention to extend the life of the rubber belt of the belt-drive transmission mechanism included the vertical internal combustion engine by preventing excessive contact between the rubber belt and the oil-containing gas from the crankcase and to ensure that the rubber belt is properly lubricated.

To achieve the object, the present invention provides a vertical internal combustion engine including: a crankshaft enclosed in a crank chamber with its center axis vertically extended; a driven mechanism including a driven shaft rotatively driven by the crankshaft; and a belt-drive transmission mechanism held in a belt chamber and including a belt made of rubber and lubricated with oil; wherein the belt chamber is provided with isolating means for isolating the belt chamber from the crankcase chamber such that an oil-containing gas flowing from the crankcase chamber into the belt chamber flows in a direction deviating from a direction toward the belt, and lubricating means for supplying oil concentratedly to the belt.

According to the present invention, the belt chamber is isolated from the crankcase such that the oil-containing gas flowing from the crankcase chamber into the belt chamber flows in a direction deviating from a direction toward the belt. Consequently, less oil-containing gas, as compared with oil-containing gas that comes into contact with the belt when the oil-containing gas flows toward the belt, touches the belt and hence the degradation of the belt resulting from contact with the oil and blowby gases contained in the oil-containing gas can be suppressed. Therefore, the lubrication of the belt with the oil can extend the life of the belt and maintenance interval. The lubricating means supplies the oil for lubricating the belt concentratedly to a limited range in the belt. Whereas the belt lubricated with the oil contained in the oil-containing gas is always entirely wetted with the oil, the belt lubricated by the lubricating means can be lubricated by a measured quantity of the oil or a desired part of the belt can be wetted with the oil. Thus the belt can be properly lubricated.

In a practical example of the present invention, the isolating means is a partition wall, and the lubricating means are jet nozzles disposed in the belt chamber.

The belt is lubricated with the oil spouted through the jet nozzles disposed in the belt chamber, the amount of the oil to be discharged onto the belt and a part of the belt to be wetted with the oil discharged through the jet nozzles can be easily determined and hence the belt can be properly lubricated.

In another practical example of the present invention, the isolating means has an intermediate wall, the lubricating means has oil holes formed in the intermediate wall, and the oil holes are disposed such that the oil separated from the oil-containing gas from the crankcase drops through the oil holes onto the belt.

Since the belt is lubricated with the oil dropped through the oil holes formed in the intermediate wall, a part of the belt to be wetted with the oil dripped through the oil holes can be easily determined and hence the belt can be properly lubricated. Since the oil for lubricating the belt is extracted from the oil-containing gas, the oil separating ability of a breather chamber included in a breather structure may be low and hence the breather chamber may be small.

DESCRIPTION OF THE PREFERRED EMBODIMENTS

Preferred embodiments of the present invention will be described with reference to FIGS. 1 to 7.

FIGS. 1 to 5 illustrate a vertical internal combustion engine E in a first embodiment of the present invention.

Figure 1:
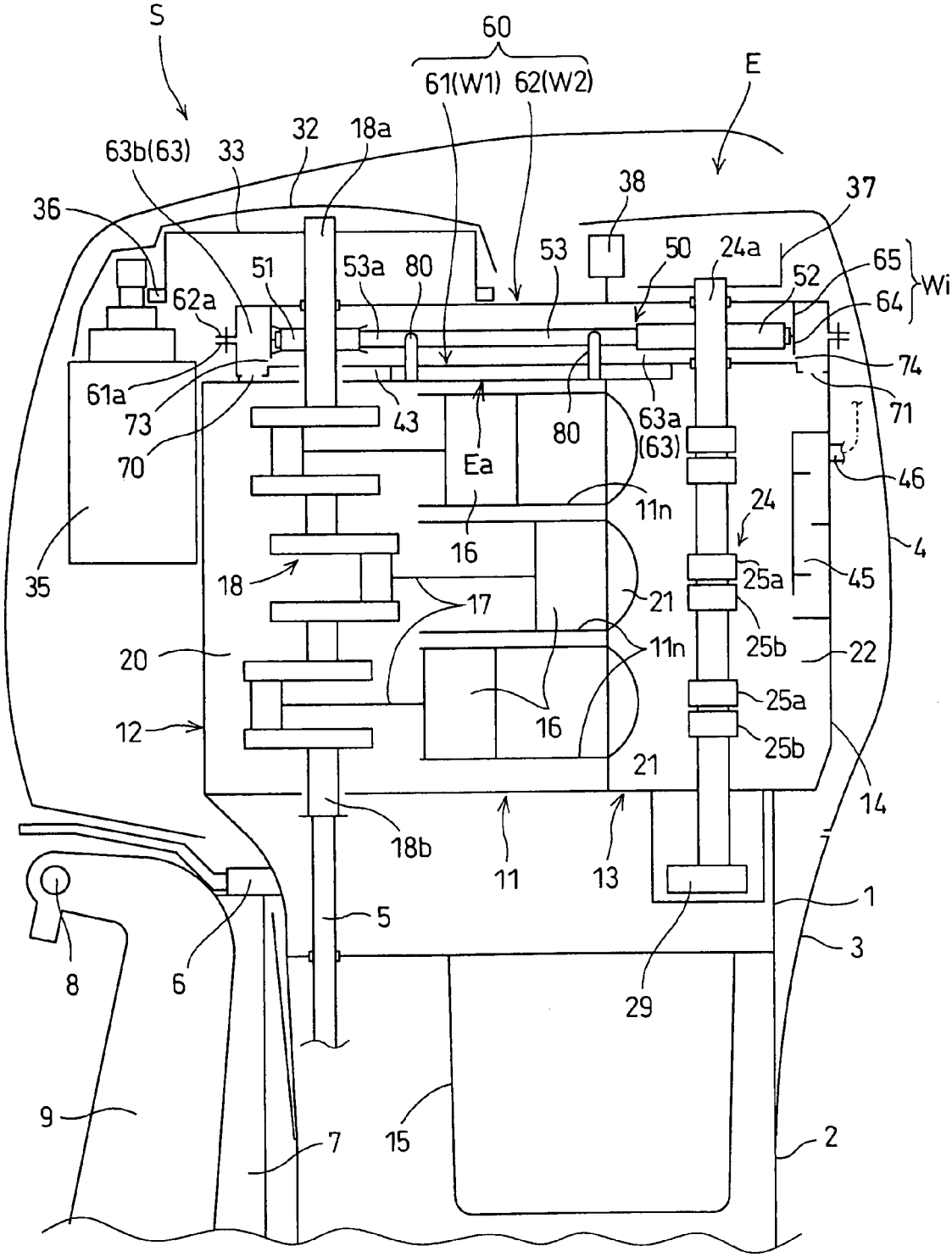
FIG. 1 is a schematic side elevation of an outboard motor provided with a vertical internal combustion engine in a first embodiment of the present invention taken from the left side of the outboard motor.

Referring to FIG. 1, the vertical internal combustion engine E is incorporated into an outboard motor S. The outboard motor S includes the internal combustion engine E disposed with the center axis of its crankshaft 18 vertically extended, a mount case 1 supporting the internal combustion engine E, an extension case 2 joined to the lower end of the mount case 1, a gear case joined to the lower end of the extension case 2, an under cover 3 covering a part between a lower part of the internal combustion engine E and an upper part of the extension case 2, and an engine cover 4 joined to the upper end of the under cover 3.

The outboard motor S has a transmission mechanism including a drive shaft 5 coaxially connected to a lower end part 18*b* of the crankshaft 18, a reversing mechanism held in the gear case, and a propeller. The power of the internal combustion engine E is transmitted from the crankshaft 18 through the drive shaft 5 and the reversing mechanism to the propeller.

A mounting device for mounting the outboard motor S on the stern of a hull has a swivel shaft 6 fixed to the mount case 1 and the extension case 2, a swivel case 7 supporting the swivel shaft 6 for turning thereon, a tilting shaft 8 supporting the swivel case 7 so as to be turnable in a vertical plane, and a bracket 9 holding the tilting shaft 8 and attached to the stern of the hull. The mounting device holds the outboard motor S so as to be turnable on the tilting shaft 8 in a vertical plane relative to the hull and so as to be turnable on the swivel shaft 6 in a horizontal plane.

Figure 2:
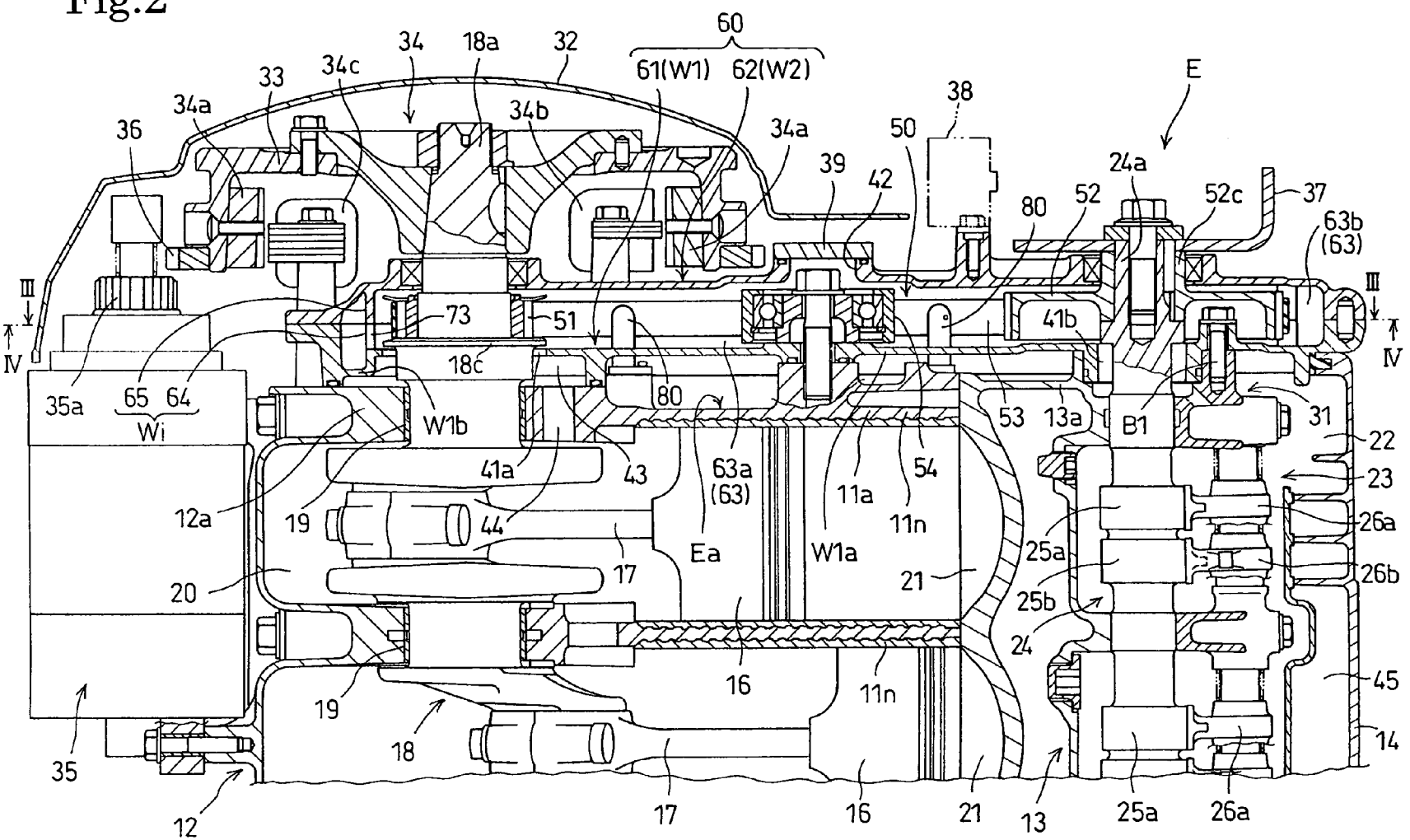
FIG. 2 is an enlarged sectional view of an essential part of the vertical internal combustion engine shown in FIG. 1.

Referring to FIGS. 1 and 2, the internal combustion engine E, which is a multicylinder 4-stroke internal combustion engine, has an engine body including a cylinder block 11 provided with three cylinders 11*n* arranged in a row in a vertical direction, a crankcase 12 joined to the front end of the cylinder block 11, a cylinder head 13 joined to the rear end of the cylinder block 11, and a head cover 14 joined to the rear end of the cylinder head 13, and an oil pan 15 placed in the extension case 2 and joined to the lower end of the mount case 1.

Pistons 16 are fitted in the cylinders 11*n* for reciprocation in the cylinders 11*n*, respectively. The pistons 16 are connected by connecting rods 17, respectively, to the crankshaft 18 placed in a crank chamber 20 defined by the cylinder block 11 and the crankcase 12. The vertical crankshaft 18 is supported for rotation in main bearings 19 on the cylinder block 11 and the crankcase 12 with its center axis extended substantially parallel to a vertical direction.

The cylinder head 13 is provided with combustion chambers 21 respectively opposed to the pistons 16 with respect to a direction parallel to the axes of the cylinders 11*n*, intake ports respectively opening into the combustion chambers 21, exhaust ports respectively opening into the combustion chambers 21, and spark plugs respectively facing the combustion chambers 21. The cylinder head 13 is provided with intake valves for opening and closing the intake ports, and exhaust valves for opening and closing the exhaust ports. The intake valves and the exhaust valves are driven for opening and closing operations in synchronism with the rotation of the crankshaft 18 by an overhead camshaft type valve train 23 disposed in a valve train chamber 22 defined by the cylinder head 13 and the head cover 14.

The valve train 23 includes a camshaft 24 provided with intake cams 25*a* and exhaust cams 25*b*, intake rocker arms 26*a* supported for rocking motions on a rocker arm shaft, and exhaust rocker arms 26*b* supported for rocking motions on a rocker arm shaft. The camshaft 24 is driven for rotation by the crankshaft 18 through a belt-drive transmission mechanism 50. The camshaft 24 has a center axis parallel to that of the vertical crankshaft 18. The intake valves and the exhaust valves are driven for opening and closing motions by the intake rocker arms 26*a* and the exhaust rocker arms 26*b* driven by the intake cams 25*a* and the exhaust cams 25*b*, respectively. The valve train 23 is a driven device provided with the camshaft 24, namely, a driven shaft, driven for rotation by the crankshaft 18.

Figure 3:
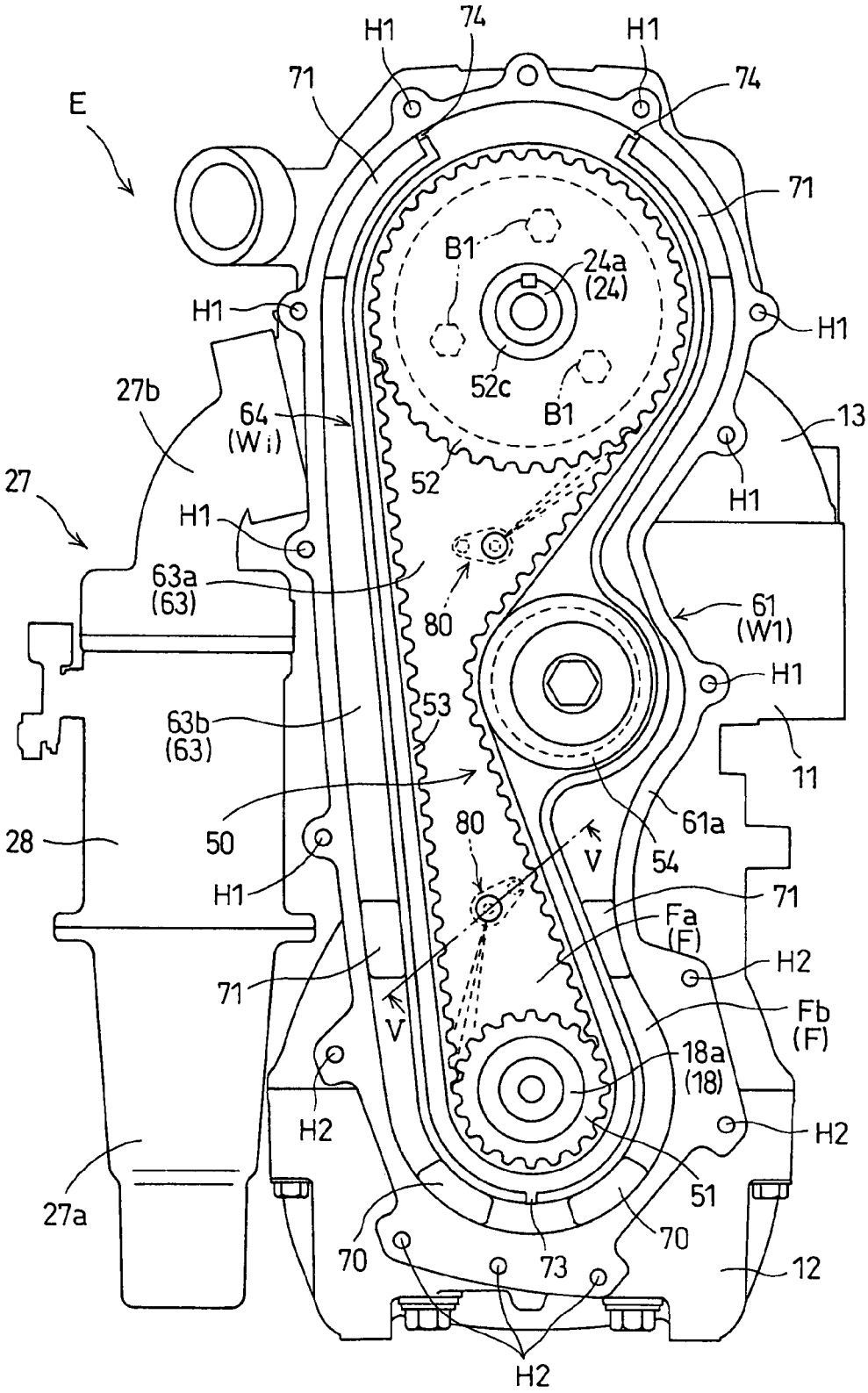
FIG. 3 is a sectional view taken on the line III-III in FIG. 2.
Figure 4:
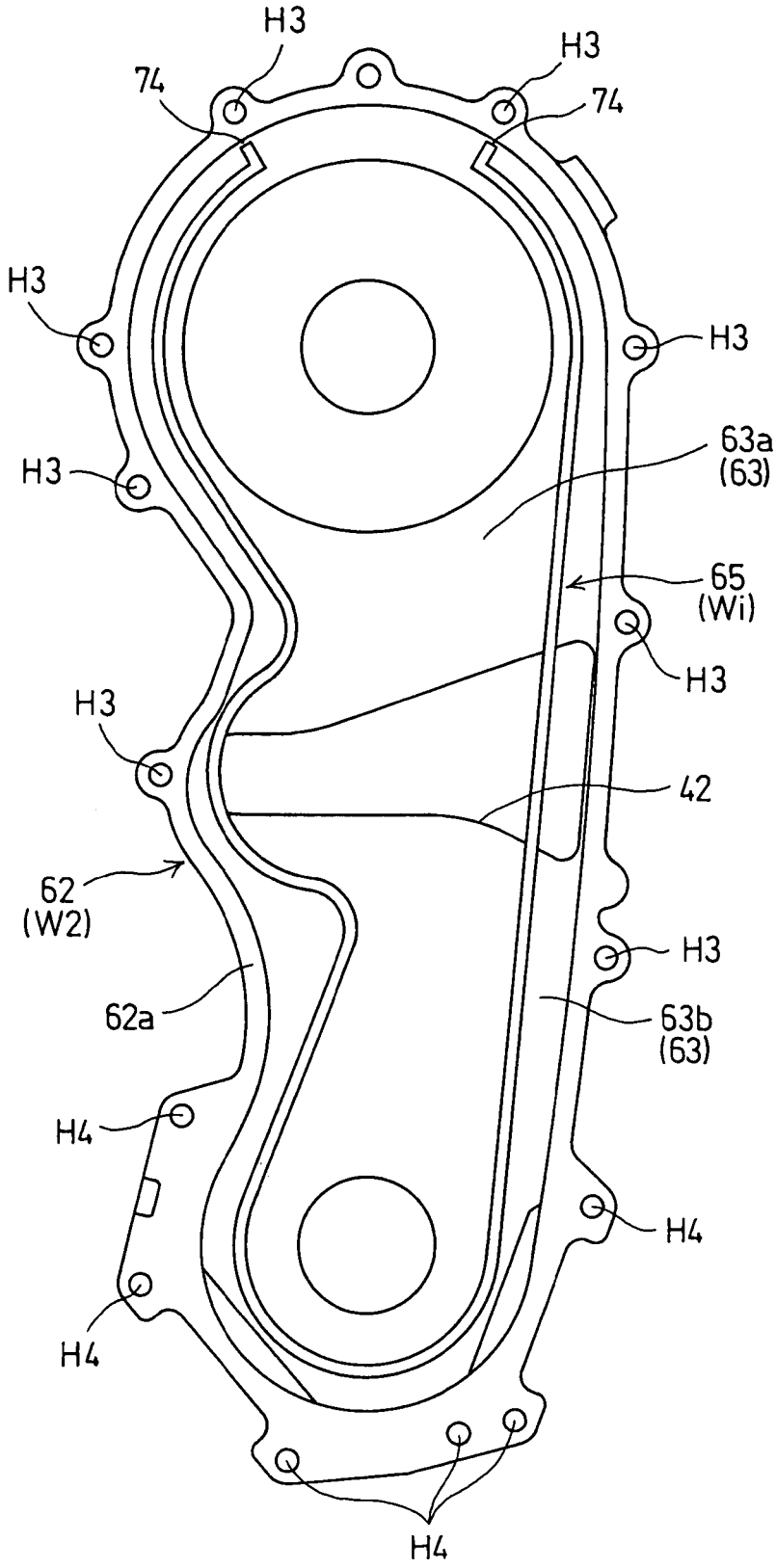
FIG. 4 is a sectional view taken on the line IV-IV in FIG. 2.

Referring also to FIG. 3, the internal combustion engine E has an intake system 27 including an inlet air silencer 27*a*, and an intake pipe 27*b* for carrying intake air taken in through the inlet air silencer 27*a* and metered by a throttle valve included in a carburetor 28 to the intake ports. The intake air that flows through an intake passage in the intake system 27 is mixed with fuel in a carburetor 28 for each cylinder 11*n* to produce an air-fuel mixture. The air-fuel mixture is sucked through the intake pipe 27*b* and the intake port into the combustion chamber 21. Then, the air-fuel mixture is ignited by the spark plug and burns to produce a combustion gas. Thus the pistons 16 are reciprocated by the pressure of the combustion gas and drive the crankshaft 18 for rotation through the connecting rods 17.

The combustion gas discharged as exhaust gas from the combustion chambers 21 flows through the exhaust ports into an exhaust manifold passage formed in the cylinder block 11. Then, the exhaust gas is discharged through passages formed in the mount case 1, the exhaust pipe and the extension case 2 into the water.

The internal combustion engine E is provided with a lubrication system including the oil pan 15 placed below the cylinder block 11, the cylinder head 13 and the crankcase 12, an oil pump 29 (FIG. 1) driven by the camshaft 24 supported on the cylinder head 13, and oil passages. The oil pump 29 pumps up oil through a suction oil passage formed in the mount case 1, the cylinder block 11 and the cylinder head 13 from the oil pan 15. The oil discharged from the oil pump 29 flows through a discharge oil passage formed in the cylinder head 13 and the cylinder block 11 and an oil filter into a main oil gallery. The oil that has flowed into the main oil gallery is distributed through oil passages formed in the cylinder block 11, the cylinder head 13 and the crankshaft 18 to parts requiring lubrication including moving parts of the crankshaft 18 and the main bearings 19 in the crank chamber 20, and moving parts of the valve train 23 including the camshaft 24 and the rocker arms 26*a* and 26*b* in the valve train chamber 22. The used oil flows through return passages formed in the cylinder block 11, the cylinder head 13 and the mount case 1 and returns to the oil pan 15.

Referring to FIG. 2, the belt-drive transmission mechanism 50 is disposed in a belt chamber 63 defined by a transmission case 60 included in the internal combustion engine E. The transmission case 60 has a lower case 61, namely, a first case, joined to the upper end $E_a$ of the engine body, and an upper case 62, namely, a second case, joined to the lower case 61. The lower case 61 forms a bottom wall W1, namely, a first wall, and the upper case 62 forms a top wall W2, namely, a second wall. The bottom wall W1 and the top wall W2 defines the belt chamber 63. The respective flanges 61*a* (FIG. 3) and 62*a* (FIG. 4) of the lower case 61 and the upper case 62 are joined together in an oil-tight fashion with bolts not shown, passed through through holes H3 (FIG. 4) formed in the upper case 762 and screwed into threaded holes H1 (FIG. 3) formed in the lower case 61, and bolts, not shown, passed through through holes H4 formed in the upper case 62 and through holes H2 formed in the lower case 61 and screwed into threaded holes formed in respective upper end parts 11*a* and 12*a* (FIG. 2) of the cylinder block 11 and the crankcase 12. The lower case 61 is fastened to an upper end part 13*a* of the cylinder head 13 with bolts B1 and connected to the upper end part 13*a* by a camshaft holder 31. The upper end parts 11*a*, 12*a* and 13*a* form an upper end part $E_a$ of the engine body. The bottom wall W1 and the top wall W2 define the belt chamber 63.

The belt-drive transmission mechanism 50 includes a drive pulley 51, a driven pulley 52, a belt 53 made of rubber, namely, an endless toothed belt, and a tension pulley 54 (FIG. 3). The drive pulley 51 is mounted in the belt chamber 63 on an upper end part 18*a* of the crankshaft 18 extended vertically upward through the lower case 61 and the upper case 62. The driven pulley 52 is mounted in the belt chamber 63 on an upper end part 24*a* of the camshaft 24 extended vertically upward through the lower case 61 and the upper case 62. The belt 53 is extended between the drive pulley 51 and the driven pulley 52 and is tensioned by the tension pulley 54.

Referring to FIGS. 1 and 2, a part of the upper end part 18*a* projected upward from the upper case 62 is covered with a cover 32 attached to the upper case 61. An AC generator 34 is disposed in a space covered with the corer 32. The AC generator 34 includes a flywheel 33, permanent magnets 34*a* attached to the flywheel 33, an exciter coil 34*b* for ignition fixedly held on the upper end $E_a$ of the engine body, and a charging coil 34*c*. A ring gear 36 is attached to the circumference of the flywheel 33. A pinion 35*a* mounted on the drive shaft of a starting motor 35 is brought into mesh with the ring gear 36. A pulser rotor 37 is mounted on the upper end part 24*a* of the camshaft 24. A pulser coil 38 for generating a pulse signal indicating an angular position of the camshaft 24 is attached to the upper case 62.

The upper case 62 is provided with openings through which the upper end parts 18*a* and 24*a* and the boss 52*c* of the driven pulley 52 are extended, and a hand hole 42 for adjusting the position of the tension pulley 54. The hand hole 42 is covered with a cover 39. Joints between the upper end parts 18*a* and 24*a* and the boss 52*c* and the openings are sealed in an oil-tight fashion.

Referring to FIGS. 2 and 3, the lower case 61 disposed between the crank chamber 20 and the belt chamber 63 with respect to the vertical direction is provided with opening 41*a* and 41*b* through which the upper end parts 18*a* and 24*a* are passed, respectively, crank chamber vent holes 70 opening into the crank chamber 20, and valve train chamber vent holes 71 opening into the valve train chamber 22. The vent holes 70 open into a space 43 between the lower case 61 and the respective upper end parts 11*a* and 12*a* of the cylinder block 11 and the crankcase 12. The vent holes 70 communicate with the crank chamber 20 by way of a connecting passage 44 formed in the upper end 11*a*. A part of the lower case 61 around the opening 41*a* is joined to the cylinder block 11 and the crankcase 12 in an oil-tight fashion. A part of the lower case 61 around the opening 41*b* is joined to the cylinder head 13 and the camshaft holder 31 in an oil-tight fashion.

The circular opening 41*a* is slightly greater than a circular flange 18*c* formed on the upper end part 18*a* of the crankshaft 18. Therefore, the flow of the gas between the crank chamber 20 and the belt chamber 63 through the opening 41*a* is very small and negligible as compared with the flow of the gas through the vent holes 70 and 71. Thus the gas flows between the crank chamber 20 and the belt chamber 63 substantially only through the vent holes 70, and the gas flows between the valve train chamber 22 and the belt chamber 63 substantially only through the vent holes 71.

The vent holes 70 and 71 lie below the belt 53. Suppose that the belt chamber 53 is divided into an inside area surrounded by the belt 53 and an outside area extending outside the belt 53 in a horizontal plane. The vent holes 70 and 71 are formed in the outside area, namely, an area extending between the belt-drive transmission mechanism 50 and the flange 61*a*. Therefore, the vent holes 70 and 71 do not overlap the belt-drive transmission mechanism 50 in a horizontal plane. Thus the lower case 61 serves as a shielding member or a partition wall entirely or substantially entirely isolating an overlying part of the belt-drive transmission mechanism 50 overlying the crank chamber 20 from the crank chamber 20 as viewed in a vertical direction or in a horizontal plane, and the vent holes 70 and 71 do not overlap the overlying part of the belt-drive transmission mechanism 50 corresponding to the crank chamber 20 as viewed in a horizontal plane. In this embodiment, the overlying part of the belt-drive transmission mechanism 50 includes at least a part 53*a* (FIG. 1) of the belt 53 overlying the crank chamber 20 in a plane containing the belt 53 among the components of the belt-drive transmission mechanism 50.

Referring to FIGS. 1 and 2, a breather structure for carrying blowby gases from the crank chamber 20 into the intake system 27 has a wall defining a breather chamber 45 in the valve train chamber 22, and a breather pipe 46 (FIG. 1) connecting the breather chamber 45 to the inlet air silencer 27*a*. The breather chamber 45 has an upstream part communicating with the valve train chamber 22, and a downstream part connected to the breather pipe 46. Blowby gases flow through the breather chamber 45 into the intake passage.

More concretely, the crank chamber 20 contains therein oil drips and oil mist produced from oil splashed by the rotating crankshaft 18 and oil discharged from the main bearings 19, and blowby gases. An oil-containing gas, namely, a mixture of blowby gases and oil mist, is drawn from the crank chamber 20 through internal breather passages, not shown, formed in the cylinder block 11 and the cylinder head 13 into the valve train chamber 22 by intake manifold vacuum created in the breather chamber 45 while the internal combustion engine E is running. In the meantime, part of the oil-containing gas flows from the crank chamber 20 through the connecting passage 44, the space 43 and the vent holes 70 into the belt chamber 63, and then flows from the belt chamber 63 through the vent holes 71 into the valve train chamber 22. Oil is separated from the oil-containing gas drawn into the valve train chamber 22 in the breather chamber 45 to produce a gas not containing oil. The gas not containing oil flows from the breather chamber 45 through the breather pipe 46 into the inlet air silencer 27*a*. Then, the gas is taken together with intake air into the combustion chambers 21.

The lower case 61 intercepts the flow of oil drops scattered in the crank chamber 20 from the crank chamber 20 into the belt chamber 63 to suppress wetting the components of the belt-drive mechanism 50 including the belt 53 with the oil drops. The oil-containing gas flowing from the crank chamber 20 toward the belt chamber 63 is stopped and deflected from the direction toward the belt chamber 63 by the lower case 61 in the space 43, and then flows through the vent holes 70 into the belt chamber 63. When the oil-containing gas comes into contact with the lower case 61, part of the oil contained in the oil-containing gas adheres to the lower case 61 and hence the oil content of the oil-containing gas is reduced.

The transmission case 60 is provided therein with an internal wall W1 (FIGS. 2 and 3), namely, a barrier wall, formed in the belt chamber 63 so as to screen the belt-drive transmission mechanism 50 from the vent holes 70 and 71. The internal wall W1 screens the belt-drive transmission mechanism 50 including the belt 53 and the pulleys 51, 52 and 54 from the oil-containing gas that flows from the crank chamber 20 through the vent holes 70 into the belt chamber 63. Thus the belt chamber 63 is isolated from the crank chamber 20 such that the oil-containing gas veers away from the belt-drive transmission mechanism 50 including the belt 53. Thus the transmission case 60 and the internal wall $W_i$ are barrier walls for isolating the belt chamber 63 from the crank chamber 20.

Referring to FIGS. 2 and 3, the internal wall $W_i$ surrounding the belt 53 has a height equal to the vertical distance between the bottom wall W1 and the top wall W2 defining the belt chamber 63. The internal wall $W_i$ surrounds the belt-drive transmission mechanism 50 including the belt 53 substantially entirely in a horizontal plane. As shown in FIG. 2, the internal wall $W_i$ is formed by joining together the lower, internal side wall 64 of the lower case 61 and the upper internal side wall 65 of the upper case 62, which are substantially parallel to each other with respect to a vertical direction. The internal side walls 64 and 65 surround the belt-drive transmission mechanism 50 including the belt 53, and the pulleys 51, 52 and 54 substantially entirely in a horizontal plane.

The belt chamber 63 is a dual chamber including an inner chamber 63*a* extending on the inner side of the internal wall $W_i$ and holding the entire belt-drive transmission mechanism 50, and an outer chamber 63*b* into which the vent holes 70 and 71 open. The internal wall $W_i$ is provided with a plurality of connecting ports 73 and 74 by way of which the inner chamber 63*a* and the outer chamber 63*b* communicate with each other.

The connecting port 73 is a crank-chamber-side connecting port on the side of the crank chamber 20 with respect to a direction parallel to the axes of the cylinders. The connecting ports 74 are valve-train-chamber-side connecting ports on the side of the valve train chamber 22 with respect to a direction parallel to the axes of the cylinders. The connecting port 73 is a slit (FIG. 2) formed in a part of the lower, internal side wall 64 extending along the belt 53 between the two vent holes 70. The connecting ports 74 are formed in an end part of the lower, internal side wall 64 and an end part of the upper, internal side wall 65 lying near the belt 53 between the vent holes 71. The connecting ports 74 are recesses or slits. The connecting ports 73 and 74 are on the opposite sides, respectively, of the belt 53 and the pulleys 51 and 52 with respect to a direction parallel to the axes of the cylinders.

The respective sectional areas of the connecting ports 73 and 74 are smaller than those of the vent holes 70 and 71. The respective sectional areas of the connecting ports 73 and 74 are determined such that the flow of the oil-containing gas into the inner chamber 63*a* is restricted to the least possible extent and oil discharged through jet nozzles 80 to be described later can flow out smoothly from the inner chamber 63*a*. Since the oil for lubricating the belt 53 is supplied through the jet nozzles 80, the oil mist contained in the oil-containing gas does not need to be used for lubricating the belt 53. Thus the flow of the oil-containing gas from the crank chamber 20 through the connecting ports 73 and 74 into the inner chamber 63*a* is very small.

As obvious from FIG. 2, an inner part W1*a* of the bottom wall W1, namely, the lower case 61, forming the inner chamber 63*a* is at a level above that of an outer part W1*b* of the bottom wall W1 forming the outer chamber 63*b*. The lower part W1*b* defines a recess or a groove in the bottom wall W1. The vent holes 70 and 71 are formed in the bottom of the outer part W1*b*. An inner bottom surface $F_a$ (FIG. 3) of the inner chamber 63*a* is at a level above that of the outer bottom surface $F_b$ (FIG. 3) of the outer chamber 63*b*. Therefore, the oil stays scarcely on the inner bottom surface $F_a$. The oil collected on the inner bottom surface $F_a$ flows through the connecting holes 73 and 74 into the outer chamber 63*b*, and then flows through the vent holes 70 and 71 into the crank chamber 20 and the valve train chamber 22.

Figure 5:
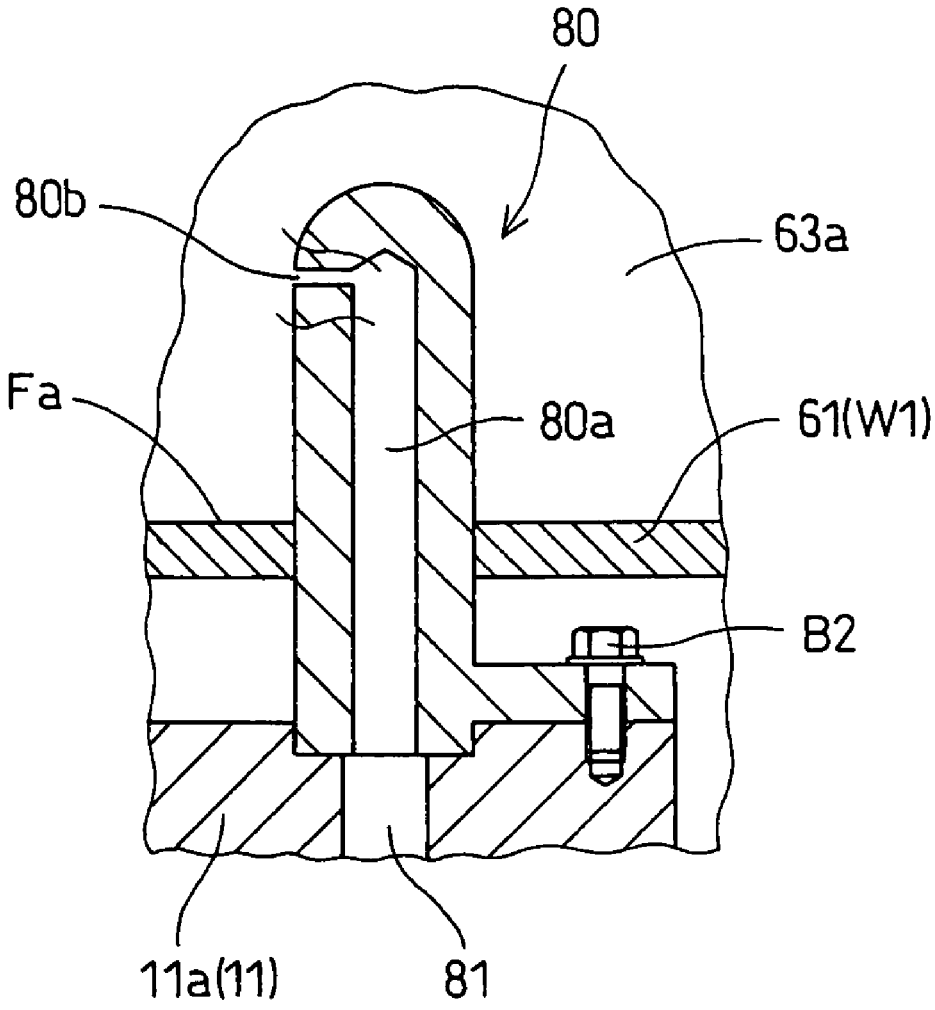
FIG. 5 is a sectional view taken on the line V-V in FIG. 3.

Referring also to FIG. 5, the internal combustion engine E is provided with the two jet nozzles 80, namely, lubricating means, for injecting the oil for lubricating the belt 53 concentratedly into the inner chamber 63*a*. Each of the jet nozzles 80 fastened to the cylinder block 11 with a bolt B2 penetrates the bottom wall W1 (the lower case 61) and partly protrudes into the inner chamber 63*a*. Each jet nozzle 80 is provided with an oil passage 80*a* connecting to an oil supply passage 81 formed in the cylinder block 11, and an injection port 80*b* connecting to the oil passage 80*a* and opening into the inner chamber 63*a*. The oil supply passage 81 communicates with the oil pump 29 (FIG. 1) by way of the main gallery. The high-pressure oil pumped by the oil pump 29 flows through the oil supply passage 81 into the jet nozzles 80. Then, the high-pressure oil is injected through the injecting port 80*a* of the jet nozzles 80 toward a contact point where the belt 53 comes into contact with the drive pulley 51 and a contact point where the belt 53 comes into contact with the driven pulley 52. The oil thus injected and dropped on the inner bottom surface $F_a$ flows on the inner bottom surface $F_a$, flows through the connecting ports 73 and 74 into the outer chamber 63*b*. Then the oil flows from the outer chamber 63*b* through the vent holes 70 and 71 into the crank chamber 20 and the valve train chamber 22.

The operation and effect of the foregoing embodiment will be described.

The transmission case 60 defining the belt chamber 63 in the internal combustion engine E has the lower case 61 (the bottom wall W1) and isolates the belt chamber 63 from the crank chamber 20. The lower case 61 thus covers the part 53*a* of the belt 53 overlying the crank chamber 20 to screen the part 53*a* from oil drips scattered from the crank chamber 20 and the oil-containing gas flowing out from the crank chamber 20. Thus the belt 53 is prevented from being excessively exposed to the oil drops and the oil-containing gas from the crank chamber 20 by the lower case 61. Moreover the belt 53 is prevented from being excessively exposed to the blowby gases contained in the oil-containing gas.

Since the lower case 61 of the transmission case 60 serves as a screening or shielding member, the internal combustion engine E does not need any special shielding member. Thus the lower case 61 reduces the component parts and the cost of the internal combustion engine E.

The belt chamber 63 defined by the transmission case 60 is isolated from the crank chamber 20 such that the oil-containing gas does not flow from the crank chamber 20 directly toward the belt 53 and the oil is injected concentratedly on the belt 53 in the belt chamber 63 through the jet nozzles 80. The internal wall $W_i$ of the transmission case 60 isolates the belt chamber 63 such that the oil-containing gas from the crank chamber 20 does not flow directly toward the belt-drive transmission mechanism 50 including the belt 53. Such a condition exposes the belt 53 to the oil-containing gas less than a condition where the oil-containing gas flows directly toward the belt 53. Thus the degradation of the belt 53 due to exposure to the oil and the blowby gases contained in the oil-containing gas can be retarded. Lubrication of the belt 53 with the oil injected through the jet nozzles 80 extends the life of the belt 53 and can extend maintenance interval. Since the oil for lubricating the belt 53 is injected through the jet nozzles 80 concentratedly onto the limited areas on the belt 53, an oil injecting rate at which the oil is injected onto the belt 53 and parts of the belt 53 to be lubricated can be easily determined as compared with a state where the belt 53 is lubricated with the oil contained in the oil-containing gas. Thus the belt 53 can be properly lubricated.

Since the lubrication of the belt 53 does not depend on the oil contained in the oil-containing gas, the flow of the oil-containing gas into the inner chamber 63*a* can be sharply cut and hence the belt 53 is exposed scarcely to the blowby gases contained in the oil-containing gas. Thus the degradation of the belt 53 due to exposure to the blowby gases can be effectively prevented.

Figure 6:
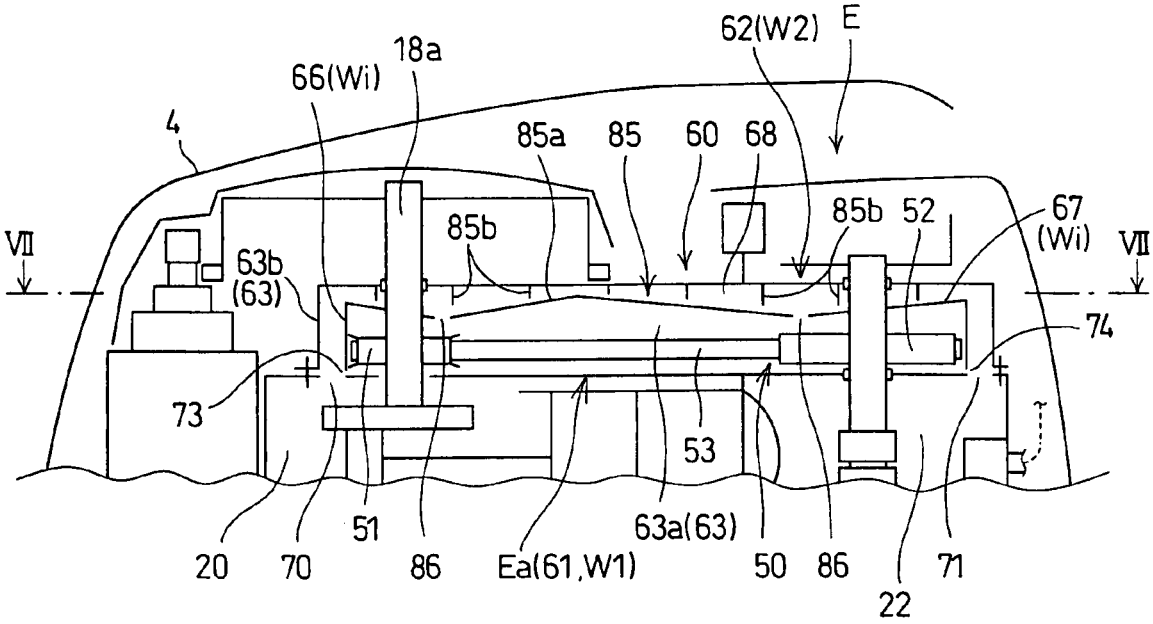
FIG. 6 is a schematic sectional view of a vertical internal combustion engine in a second embodiment of the present invention taken from the left side of the outboard motor.
Figure 7:
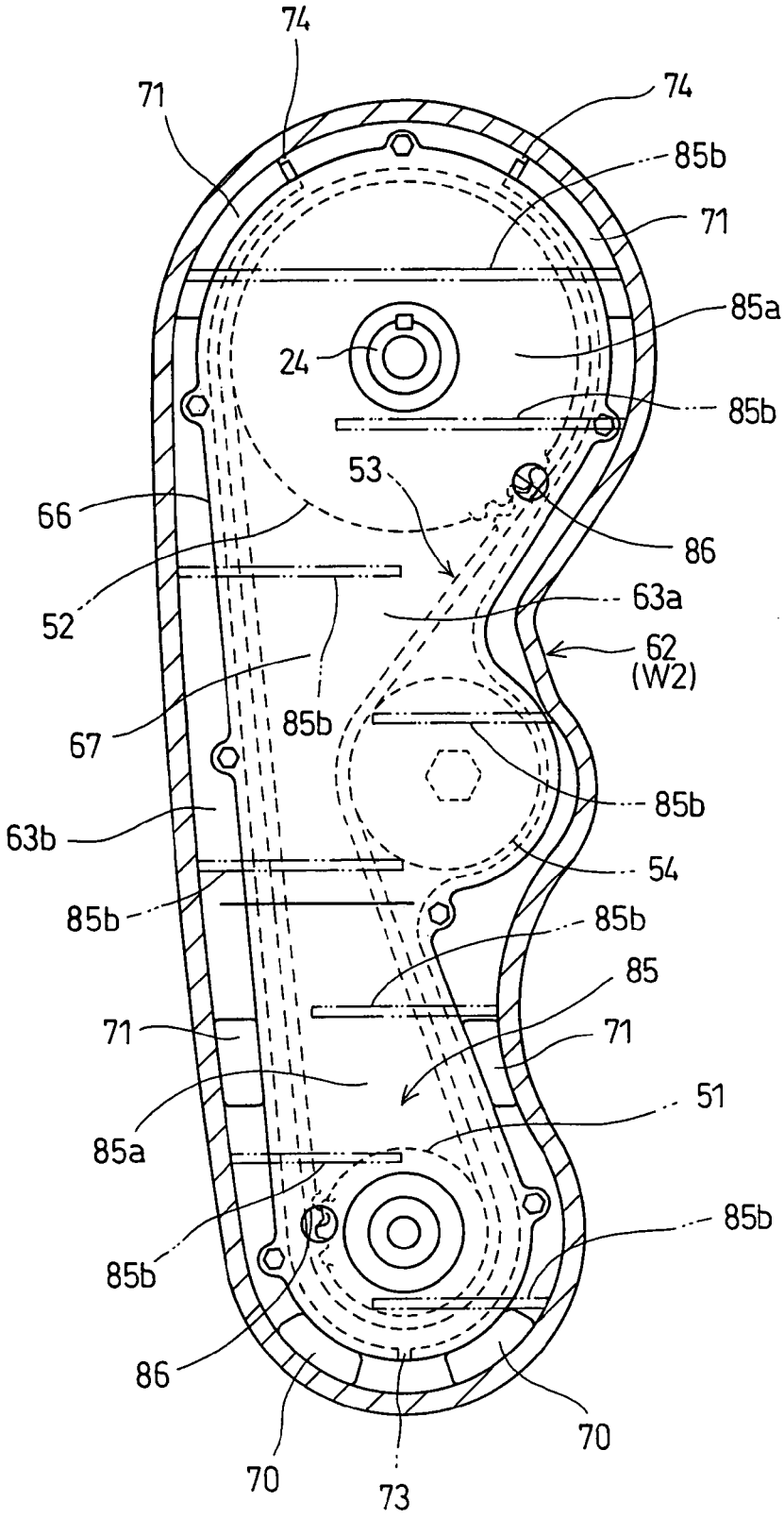
FIG. 7 is a sectional view taken on the line VII-VII in FIG. 6.

An internal combustion engine E in a second embodiment of the present invention will be described with reference to FIGS. 6 and 7. The internal combustion engine E in the second embodiment excluding a transmission case 60 is basically identical in construction with the internal combustion engine E in the first embodiment. In FIGS. 6 and 7, parts like or corresponding to those of the internal combustion engine E in the first embodiment are designated by the same reference characters and the description thereof will be omitted.

An upper end part $E_a$ of an engine body serves as a lower case 61 (a bottom wall W1) of a transmission case 60 defining a belt chamber 63. An upper case 62 is joined to the upper end part $E_a$. An internal wall $W_i$ is fastened to the upper end part $E_a$ with bolts. The internal wall $W_i$ has a vertically rising side wall 66 substantially entirely surrounding a belt-drive transmission mechanism 50, and a horizontally extending intermediate wall 67 having the shape of a plate and joined to the upper end of the side wall 66. The side wall 66 and the intermediate wall 67 are formed integrally in a single piece or formed separately and joined together.

In the second embodiment, the upper end part $E_a$ of the engine body serves as the bottom wall W1 of the belt chamber 63. A top wall W2 of the belt chamber 63 includes the upper case 62 serving as an outer top wall, and the intermediate wall 67 serving as an inner top wall.

The belt chamber 63 is divided by the internal wall $W_i$ into an inner chamber 63*a* holding the belt-drive transmission mechanism 50, and an outer chamber 63*b*. Vent holes 70 and 71 opens into the outer chamber 63*b*. Side wall 66 is provided with connecting holes 73 and 74.

A lubricating device is disposed between the upper case 62 and the intermediate wall 67 with respect to a vertical direction in the outer chamber 63*b*. The lubricating device has an oil separating structure 85 for separating oil contained in an oil-containing gas that flows from a crank chamber 20 through the vent holes 70 into the outer chamber 63*b*, and oil holes 86 through which the oil separated from the oil-containing gas by the oil separating structure 85 is dropped concentratedly onto a belt 53 included in the belt-drive transmission mechanism 50 in the inner chamber 63*a*.

The oil separating structure 85 includes two collecting parts of the intermediate wall 67 each having a taper surface 85*a* tapering down toward the oil hole 86, and baffle plates 85*b*, namely, gas-liquid separating means, disposed in a passage 68 through which the oil-containing gas flows so as to obstruct the flow of the oil-containing gas. The baffle plates 85*b* are extended vertically downward from the upper case 62 so as to be spaced apart from the taper surfaces 85*a* of the intermediate wall 67. All the baffle plates 85*b* may be extended vertically upward from the intermediate wall 67. Some of the baffle plates 85*b* may be extended downward from the upper case 61 and the rest may be extended vertically upward from the intermediate wall 67.

As the oil-containing gas flows into the passage 68 in a part of the outer chamber 63*b* over the intermediate wall 67 through the vent holes 70 and flows out from the passage 68 through the vent holes 71, the oil-containing gas comes into contact with the baffle plates 85*b* in the passage 68. Consequently, the oil contained in the oil-containing gas is separated from the oil-containing gas. The oil thus separated from the oil-containing gas drips onto and flows along the taper surfaces 85*a*. Then, the oil drips in oil drips through the oil holes 86 on a contact point where the belt 53 comes into contact with a drive pulley 51 and a contact point where the belt 53 comes into contact with a driven pulley 52.

The second embodiment exercises the following operation and effect in addition to the operation and effect exercised by the first embodiment.

The transmission case 60 is provided with the internal wall $W_i$ isolating the belt chamber 63 from the crank chamber 20, the oil supply means includes the oil holes 86 formed in the top wall W2, the oil separated from the oil-containing gas from the crank chamber 20 by the baffle plates 85*a* and flowing on the top wall 67 of the top wall W2 drips through the oil holes 86 onto the belt 53 to lubricate the belt 53. Thus parts of the belt 53 onto which the oil drips can be easily determined and hence the belt 53 can be properly lubricated since the oil separated from the oil-containing gas and dripping through the oil holes 86 is used for lubricating the belt 53. Therefore, a breather chamber 45 of a breather structure may have a low oil separating function and hence the breather chamber 45 may be small.

Modifications of the foregoing embodiments will be described.

The internal wall $W_i$ may surround the belt-drive transmission 50 entirely in a horizontal plane, excluding the connecting holes 73 and 74.

The driven device may be an accessory having a driven shaft, such as the oil pump 20 having the rotating shaft or another transmission mechanism.

A flywheel may be mounted on a lower end part 18*b* of the crankshaft 18, and the drive shaft 5 may be connected through the flywheel to the crankshaft 18.

The belt chamber 63 may be disposed within the engine body or under the engine body instead of being disposed above the engine body.

The vertical internal combustion engine may be a single-cylinder internal combustion engine and may be incorporated into a machine other than the outboard motor.

What is claimed is:

1. A vertical internal combustion engine comprising:

a hollow crankcase having a crank chamber formed therein;

a transmission case attached to an upper portion of the crankcase and having a belt chamber formed therein;

a crankshaft enclosed in the crank chamber and oriented with its center axis substantially vertically extended;

a driven mechanism including a driven shaft rotatively driven by the crankshaft;

a belt-drive transmission mechanism held in the belt chamber and including a belt made of rubber for transmitting power of the crankshaft to the driven shaft; and a lubrication delivery structure for supplying a regulated amount of oil to the belt;

wherein the engine is provided with a substantially horizontally-oriented partition wall disposed between the crank chamber and the belt chamber, wherein the partition wall is configured and arranged for substantially isolating the belt chamber from the crank chamber such that an oil-containing gas, flowing from the crank chamber into the belt chamber, flows in a direction other than a direction toward the belt.

2. The vertical internal combustion engine according to claim 1, wherein the lubricating delivery structure includes an oil jet nozzle disposed in the belt chamber.

3. The vertical internal combustion engine according to claim 1, wherein the partition wall is formed by a bottom wall of the transmission case defining the belt chamber, and the bottom wall is provided with a first vent hole through which the oil-containing gas flows from the crank chamber into the belt chamber in a direction other than a direction toward the belt.

4. The vertical internal combustion engine according to claim 1, wherein the lubricating delivery structure includes jet nozzles disposed in the belt chamber.

5. The vertical internal combustion engine according to claim 3, wherein the bottom wall of the transmission case is provided with a second vent hole through which the oil-containing gas flows from the belt chamber into the driven mechanism including the driven shaft.

6. The vertical internal combustion engine according to claim 1, wherein the crankshaft and the driven shaft have respective end parts projecting into the belt chamber, the belt is extended between the end part of the crankshaft and the end part of the driven shaft for power transmission, the lubricating delivery structure is disposed to supply oil to positions respectively adjacent to the end part of the crankshaft and the end part of the driven shaft.

7. The vertical internal combustion engine according to claim 1, wherein the crankshaft and the driven shaft have respective end parts projecting into the belt chamber, the belt is extended between the end part of the crankshaft and the end part of the driven shaft for power transmission, and an internal wall is formed in the belt chamber so as to surround the respective end parts of the crankshaft and the driven shaft, and also to surround the belt.

8. The vertical internal combustion engine according to claim 7, wherein the internal wall is provided with connecting ports which permit communication between an inner chamber on an inner side of the internal wall and an outer chamber on an outer side of the internal wall of the belt chamber.

9. The vertical internal combustion engine according to claim 1, wherein the lubricating delivery structure comprises an oil dropping structure.

10. The vertical internal combustion engine according to claim 7, wherein the internal wall is provided with a top wall having an oil separating structure, and the oil separating structure includes baffle plates for separating oil contained in an oil-containing gas flowing over the top wall, and collecting parts defined in the top wall and respectively having sloping surfaces and oil holes through which the oil is dropped into a space surrounded by the internal wall.

11. The vertical internal combustion engine according to claim 1, wherein the partition wall includes an intermediate wall, the lubricating delivery structure has oil holes formed in the intermediate wall, and the oil holes are arranged such that oil separated from the oil-containing gas from the crank chamber and flowing over the intermediate wall drops through the oil holes onto the belt.

12. The vertical internal combustion engine according to claim 1, wherein the transmission case comprises an internal wall extending upwardly from the partition wall and configured to separate the belt chamber into an outer chamber outside of the internal wall, and an inner chamber inside of the internal wall, wherein the belt is disposed in the inner chamber.

13. A vertical internal combustion engine comprising:

a hollow crankcase having a crank chamber formed therein;

a transmission case attached to an upper portion of the crankcase and having a belt chamber formed therein, said transmission case comprising:

a substantially horizontally oriented partition wall substantially separating the crank chamber from the belt chamber, said partition wall having a crank-receiving opening formed therein;

an internal wall extending upwardly from the partition wall and configured to separate the belt chamber into an outer belt chamber outside of the internal wall, and an inner belt chamber inside of the internal wall;

a crankshaft enclosed in the crank chamber and oriented with its center axis substantially vertically extended;

a driven mechanism including a driven shaft rotatably driven by the crankshaft;

a belt-drive transmission mechanism held in the inner belt chamber and including a belt made of a flexibly resilient material comprising rubber for transmitting power of the crankshaft to the driven shaft; and a lubricating structure disposed in said belt chamber for supplying oil to the belt;

wherein the partition wall is configured and arranged to substantially isolate the belt chamber from the crank chamber such that an oil-containing gas flowing from the crank chamber into the belt chamber flows in a direction other than a direction toward the belt.

14. The vertical internal combustion engine according to claim 13, wherein the partition wall is formed by a bottom wall of the transmission case defining the belt chamber, and the bottom wall is provided with a first vent hole through which the oil-containing gas flows from the crank chamber into the belt chamber in a direction other than a direction toward the belt.

15. The vertical internal combustion engine according to claim 13, wherein the lubricating structure includes jet nozzles disposed in the belt chamber.

16. The vertical internal combustion engine according to claim 14, wherein the bottom wall of the transmission case is provided with a second vent hole through which the oil-containing gas flows from the belt chamber into the driven mechanism including the driven shaft.

17. The vertical internal combustion engine according to claim 13, wherein the crankshaft and the driven shaft have respective end parts projecting into the belt chamber, the belt is extended between the end part of the crankshaft and the end part of the driven shaft for power transmission, the lubricating structure is disposed to supply oil to positions respectively adjacent to the end part of the crankshaft and the end part of the driven shaft.

18. The vertical internal combustion engine according to claim 13, wherein the crankshaft and the driven shaft have respective end parts projecting into the belt chamber, the belt is extended between the end part of the crankshaft and the end part of the driven shaft for power transmission, and an internal wall is formed in the belt chamber so as to surround the respective end parts of the crankshaft and the driven shaft, and the belt.

19. The vertical internal combustion engine according to claim 13, wherein the internal wall is provided with connecting ports which permit communication between the inner belt chamber and the outer belt chamber.

* * * * *